United States Patent [19]

Pennisi

[11] Patent Number: 4,723,686

[45] Date of Patent: Feb. 9, 1988

[54] TRASH CAN LID FASTENING MEANS

[76] Inventor: Ricky C. Pennisi, 15 Soder Rd., North Caldwell, N.J. 07006

[21] Appl. No.: 942,871

[22] Filed: Dec. 17, 1986

[51] Int. Cl.[4] ..... B65D 41/06; B65D 41/36

[52] U.S. Cl. ..... 220/300; 220/1 T

[58] Field of Search ..... 220/300, 293, 1 T

[56] References Cited

U.S. PATENT DOCUMENTS 3,854,582 12/1974 Martinelli ..... 220/300

4,333,580 6/1982 Sweigart, Jr. ..... 220/300

4,473,170 9/1984 Ciancimino ..... 220/300

*Primary Examiner*—George T. Hall

*Attorney, Agent, or Firm*—Stefan J. Klauber

[57] ABSTRACT

A container having an outwardly-extending peripheral flange formed with a series of slots cooperates with a cover having a circumferential skirt which encloses the flange and has projections on its underside adjacent the skirt which are positioned to enter the slots when the cover closes the container and to interlock with the container when the cover is rotated relatively to the container.

7 Claims, 8 Drawing Figures

TRASH CAN LID FASTENING MEANS

FIELD OF THE INVENTION

This invention relates to containers and is more particularly concerned with containers to the type having a body and a cover and which are generally used for the reception of trash or garbage.

BACKGROUND OF THE INVENTION

Trash and garbage containers of the type involving a body for reception of trash or garbage and a cooperating cover often present a problem because the cover becomes dislodged and the contents spilled. This particularly true when animals try to gain access to the contents of the container. Various proposals for temporarily locking the covers to the bodies of the containers have bee proposed and are satisfactory to some extent, but they are often difficult to manipulate, or the locking means can be readily damaged and become ineffective, or they involve some other disadvantage or drawback. For example, some covers rely solely on friction to hold them in place. A variety of problems arise as a result of this construction. If the fit is very tight it becomes difficult to put the cover in place or to remove it, and if the fit is loose it is easily dislodged, especially by animals seeking access to the container contents.

One approach to the solution of this problem has been the use of springs stretched through the handle of the cover and connected to handles on the sides of the container body. In order to be effective, however, they must be tightly drawn, but this results in the springs becoming gradually stretched and they thus eventually lose their elasticity and must be frequently replaced. Numerous other proposals for securing covers to containers used for trash or garbage have been disclosed. Orofino, U.S. Pat. No. 1,351,964, for example, shows a garbage can with a body which is provided with a pin 12 welded to it upon which is mounted a roller 20 which is received in a slot 17 in the can cover. Ciancimino, U.S. Pat. No. 4,473,170 shows a garbage pail and lid arrangement wherein the lid is threaded into engagement with the pail and a cable is employed to secure the lid to the pail. Martinelli, U.S. Pat. No. 3,854,582 shows a trash can wherein the container body has projecting lugs 20 which engage with slots 42 in the cover for securing the cover to the body. The Orofino garbage can is described in connection with a metal container but, primarily for economic reasons, conventional trash and garbage cans of the type discussed are made from a plastic and projecting pins and rollers extending outwardly from the sides of the can can readily be damaged and broken off unintentionally during normal use. In practice, trash and garbage cans are not infrequently roughly handled. The same considerations are true of the lugs projecting from the upper rim of the container shown by Martinelli. The Ciancimino arrangement involves a somewhat complicated construction.

It is accordingly an object of this invention to provide a container having a body and a cover and which is of the type used for garbage and trash and which has improved means for temporarily securing and locking the cover and the body of the container to make them resistant to accidental detachment.

It is another object of this invention to provide a garbage or trash container of the character indicated which is easy to use, is resistant to damage of the body-cover locking mechanism, and is non-complicated in construction.

BRIEF SUMMARY OF THE INVENTION

In accordance with the invention, these and other objects are achieved by a garbage or trash container construction which comprises a body, which is generally tubular or cylindrical in shape and has an outwardly-extending rim or flange at its upper end, the rim being provided with a plurality of apertures, and a cover which has a downwardly-extending peripheral skirt which encloses the rim or flange of the body and has on its undersides adjacent the inner side of the skirt, and has a plurality of locking projections receivable in the apertures of the body, preferably together with indicia for instantly showing alignment of the projections and the apertures to insure easy and rapid interengagement thereof.

BRIEF DESCRIPTION OF THE DRAWINGS

The invention will now be described with reference to the accompanying drawings, wherein.

DETAILED DESCRIPTION

Figure 1:
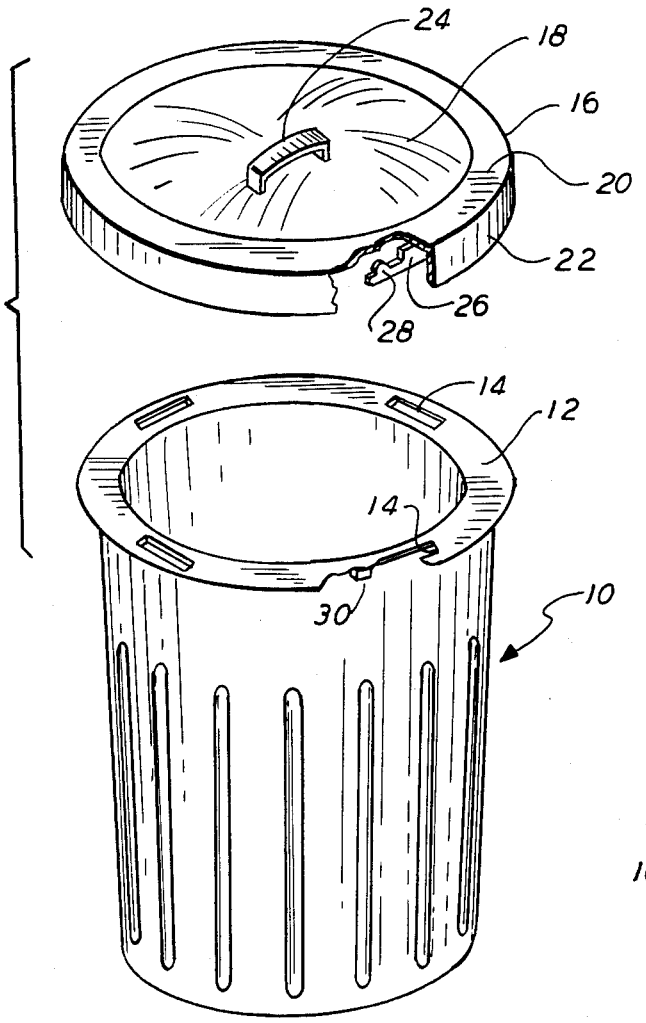
FIG. 1 is an exploded view of a garbage or trash can embodying features of the present invention.
Figure 2:
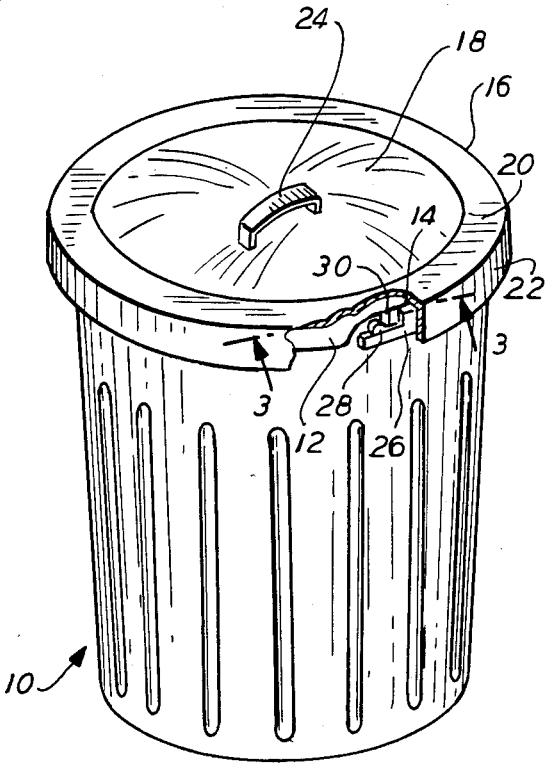
FIG. 2 is a perspective view of the embodiment of FIG. 1 in closed, locked position, partially cut away to show the relationship between a locking projection carried by the cover and the corresponding aperture in the rim or flange of the body.
Figure 3:
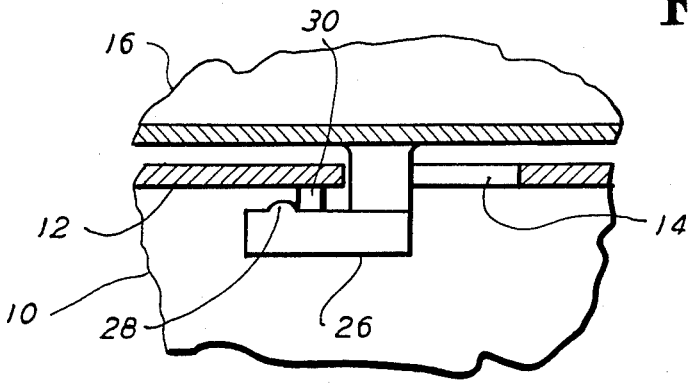
FIG. 3 is a cross-sectional view taken approximately along the line 4—4 of details of the construction embodying features of the invention.

Referring to the drawings, and particularly to FIGS. 1 & 2, the reference number 10 designates a container of the type suitable for trash or garbage accumulation having an outwardly-extending flange 12 at its upper end provided with slots 14. A cover 16 for the container has a domed central portion 18 and an annular level rim portion 20 from the outer periphery of which depends a skirt 22. In conventional manner the domed center portion 18 has a handle 24. Depending from the annular flat portion 20 are projections 26 which serve as locking devices for the cover as will be described below. The projections 26 are generally L-shaped in cross-section with their legs running substantially circumferentially. Projections 26 are dimensioned to be received in slots 14 and are equal in number to the number of slots. In a preferred form of the invention, the L-shaped leg of each extension 26 is formed with a bump or node 28 and the flange 12 is formed with depending enlargements 30 adjacent each aperture on the side of the aperture on which the leg of the extension 26 extends.

When the cover 16 and the container 10 are to be interlocked, the cover is positioned so that the depending extensions 26 are received in slots 14 and it is then rotated clockwise, i.e. in the direction of the extending legs of the extensions. As the node 28 passes beyond the enlargement 30, the enlargement falls into the space behind the node and the extensions are firmly engaged so that the cover 16 is securely but temporarily connected to the container 10, although it can be readily removed by rotating the cover in a counterclockwise direction and lifting it so that the projections are removed from the slots 14.

Figure 4:
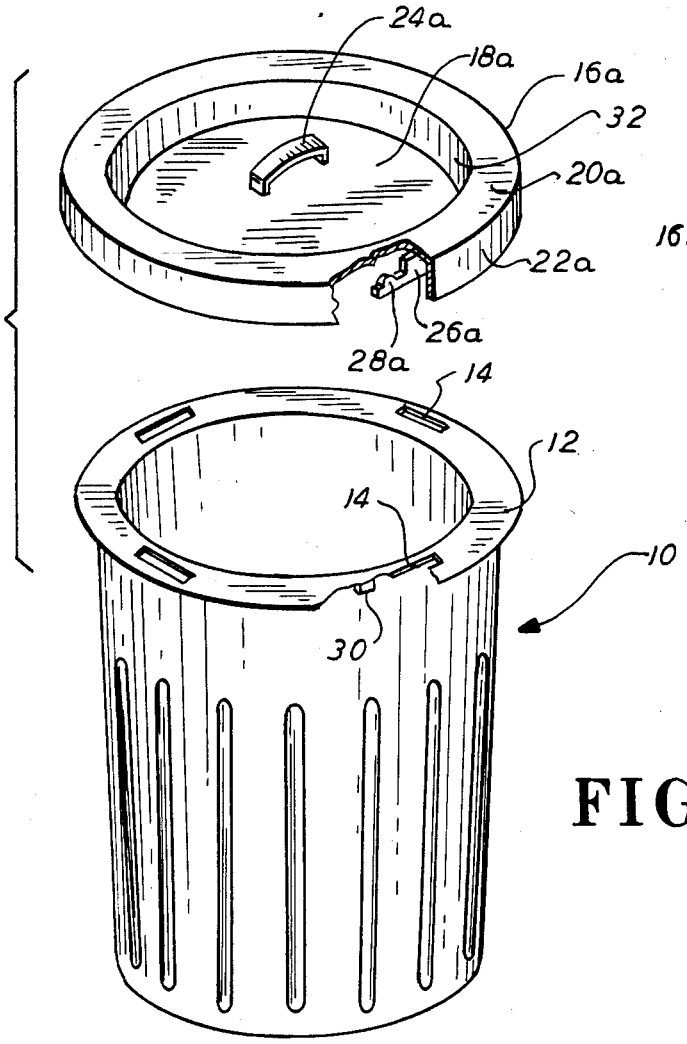
FIG. 4 is an exploded view, similar to FIG. 1, showing a garbage or trash can embodying features of the present invention and having a modified cover construction.

While the cover 16 has been described with a more or less conventional convex central portion 18, it can have a different configuration. For example, it can be level (not shown) with the annular flat portion 20 or the central portion can be depressed as as shown in FIG. 4 wherein like parts are given like reference numerals to which an a has been added. In FIG. 4, cover 16*a*, instead of having a domed or convex central portion, has a depressed central portion 18*a*, so that a circular wall 32 is formed. Wall 32 and skirt 22*a* are concentric and define an annular channel in which projections 26*a* are located. This construction serves to give further protection to the projections 26 which are already protected against accidental damage by the skirt 22 and 22*a*. The depressed cover central portion 18*a* has a handle 24*a*.

Figure 5:
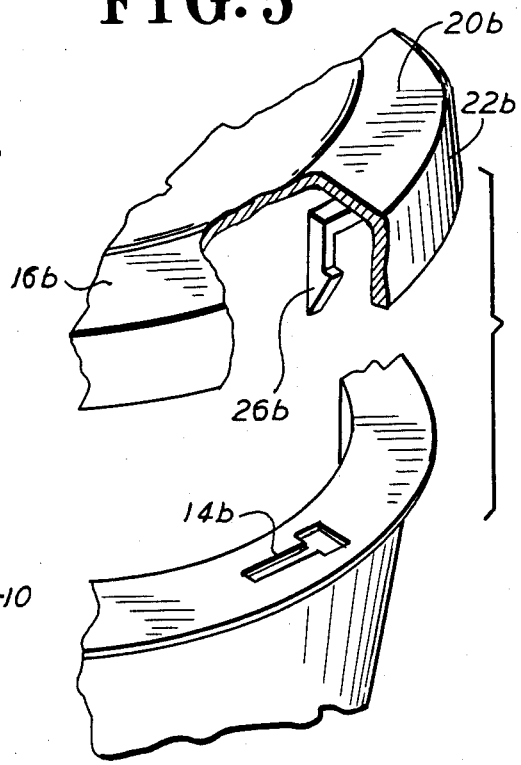
FIG. 5 is a fragmentary perspective view showing another construction embodying features of the invention.
Figure 6:
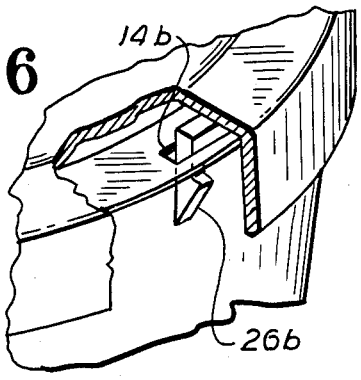
FIG. 6 is a fragmentary perspective view of the embodiment of FIG. 5 in closed, locked positions.

In either of the constructions of FIGS. 1 or 4, the form of the projections 26 and 26*a* may be varied. For example, as shown in FIGS. 5 and 6, wherein parts corresponding to those shown in FIG. 1 are given the same reference numeral to which b has been added, the projections 26*b* are semi-arrow-shaped in crosssection and extend generally radially rather than circumferentially of the cover 16*b*. In like manner, the slots 14 in the the flange 12 can be varied to accommodate the form of the projections. Thus, as shown in FIG. 5, each slot 14*b* has a generally T-shaped form and the enlargements 30 are eliminated. In this embodiment, when the container is to be closed, the projections are positioned so that the partial heads of the arrows enter the crossbar part of the T-shaped openings 14*b* and when the cover 12*b* is rotated clockwise relatively to container 12*b*, the projection heads underlie the leg portion of the T-shaped slots and hold the cover securely in place. Removal of the cover is readily achieved by counterclockwise rotation back to the position wherein the heads of the semi-arrow-headed projections can be removed through the wide portion of the slots.

The semi-arrow-shaped projections 26*b* shown in FIGS. 5 and 6 can be replaced by projections of other shapes, e.g. of somewhat mushroom-shaped cross-section (not shown) and the slots can have generally the same shape as the slots 14*b*. The cooperation between the mushroom-shaped projections and the slots to lock the cover and the container together is substantially the same as that described in connection with the embodiment illustrated in FIGS. 5 and 6.

It will be apparent that the projections can be given other configurations and the slots in the flange of the container can be given other shapes which cooperate with the shapes of the projections generally in the manner described above.

Figure 7:
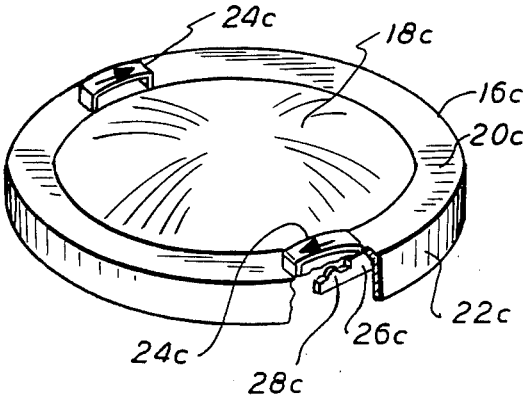
FIG. 7 is a perspective view of the cover construction showing a further embodiment in which handles carrying indicia are provided for facilitating aligning the projections on the underside of the cover with the apertures in the rim or flange of the body.

In a further preferred embodiment of the invention, the outside surface of the cover 16 can be constructed to provide indicia which indicate the location of the projections and will tend to facilitate engaging the projections with the slots in the container and interlocking the cover and container when the cover and the container are to be interengaged or even when the container is just to be closed. For example, referring to FIG. 7, in which parts corresponding to those shown in FIG. 1 are given the same reference numerals to which has been added, the cover 16*c* is provided with two oppositely positioned handles 24*c* which are provided with indicia in the shape of arrows disposed directly above two opposite projections, the arrows pointing in the clockwise direction. The indicia can be of many desired forms. For example the handles 26*c* can themselves be shaped as arrows. Instead of being shaped as arrows or the like, the handles can (as shown in FIG. 7) be of conventional form, as in FIG. 1, but with an arrow or the like indicated, e.g. by embossing, on their top surfaces. By means of the indicia, the user of the container and cover can immediately see in what position the cover and the container will go together, and how to move the cover to interengage the slots with the projections, and the use of the construction of the invention is thereby facilitated.

Figure 8:
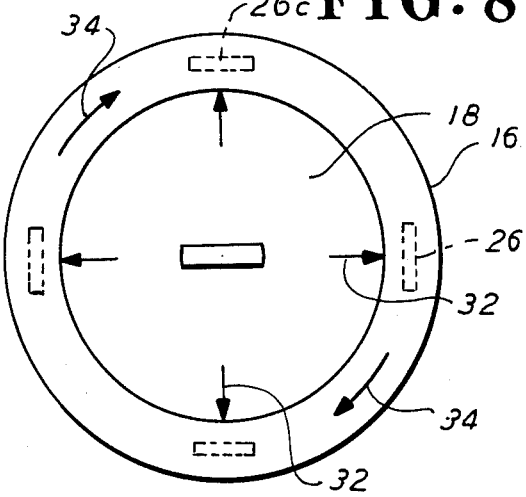
FIG. 8 is a plan view similar to FIG. 7 showing a modified arrangement of indicia.

A simplified system of indicia has been shown in FIG. 8. Thus, referring to FIG. 8, the cover of FIG. 1 is shown to which have had arrows 32 added to it to indicate the position of the underlying projections, as well as arrows 34 along the annular flat portion 20 to show the desired direction of cover rotation to effect inter-locking. The arrows 32 and 34 can be painted, printed or embossed as desired, preferably embossed. Indicia other than arrows can, of course, also be used.

It will be obvious that various other changes and modifications may be made in the container and cover construction of the invention shown in the embodiments illustrated in the drawing and discussed above, without departing from the scope of the claims and it is intended therefore that all matter contained in the drawing and in the foregoing description shall be interpreted as illustrative only and not as limitative of the invention.

I claim:

1. In combination, an open-topped container of generally tubular form and having an outwardly-extending peripheral flange at its upper, open end, said flange being provided with a plurality of evenly spaced slots, a cover for said container, said cover having a downwardly-extending circumferential skirt shaped to enclose said flange, and downwardly-extending projections adjacent and radially-inwardly of said flange corresponding in number to said slots and positioned to engage said slots in said flange when the cover is placed on said container, and to interlock with the underside of said flange when said cover is rotated relatively to said container but to be releasable therefrom solely upon counter rotation of said cover.

2. A container and cover as defined in claim 1, wherein said flange is formed on its under side with an enlargement adjacent each of said slots and said projections depending in from said cover adjacent said skirt are formed with notches for interengagement with said enlargements when the projections are directed into said slots and the cover is rotated relatively to said container.

3. A container and cover as defined in claim 1, wherein said slots are T-shaped and said projections are semi-arrow-shaped.

4. In combination, an open-topped container of generally tubular form and having an outwardly-extending peripheral flange at its upper, open end, said flange being provided with a plurality of evenly-spaced slots, a cover for said container, said cover having a downwardly-extending circumferential skirt shaped to enclose said flange, and formed with an annular channel adjacent said skirt, and downwardly-extending projections in said channel corresponding in number to said slots and positioned to engage said slots in said flange when the cover is placed on the container, and to interlock with the underside of said flange when said cover is rotated relatively to said container but to be releasable therefrom solely upon counter rotation of said cover.

5. In combination, an open-topped container of generally tubular form and having an outwardly-extending peripheral flange at its upper, open end, said flange being provided with a plurality of evenly-spaced slots, a cover for said container, said cover having a downwardly-extending circumferential skirt shaped to enclose said flange, and formed with an annular channel adjacent said skirt and downwardly-extending projections in said channel corresponding in number to said slots and positioned to engage said slots in said flange when said cover is placed on said container, and to interlock with the underside of said flange when said cover is rotated relatively to said container but to be releasable therefrom solely upon counter rotation of said cover, and said cover being provided on its top surface with indicia showing the location of said projections.

6. In combination, an open-topped container of generally tubular form and having an outwardly-extending peripheral flange at its upper, open end, said flange being provided with a plurality of evenly spaced slots, a cover for said container, said cover having a downwardly-extending circumferential skirt shaped to enclose said flange, and downwardly-extending projections adjacent and radially-inwardly of said flange corresponding in number to said slots and positioned to engage said slots in said flange when the cover is placed on said container, said flange being formed on its under side with an enlargement adjacent each of said slots and said projections depending from said cover adjacent said skirt being formed with notches for interengagement with said enlargements when the projections are directed into said slots and the cover is rotated relatively to said container.

7. In combination, an open-topped container of generally tubular form and having an outwardly-extending peripheral flange at its upper, open end, said flange being provided with a plurality of evenly spaced slots, a cover for said container, said cover having a downwardly-extending circumferential skirt shaped to enclose said flange, and downwardly-extending projections adjacent and radially-inwardly of said flange corresponding in number to said slots and positioned to engage said slots in said flange when the cover is placed on said container, said slots being T-shaped and said projections being semi-arrow shaped.

* * * * *